US010249248B2

(12) United States Patent
Lee et al.

(10) Patent No.: US 10,249,248 B2
(45) Date of Patent: Apr. 2, 2019

(54) DISPLAY DEVICE

(71) Applicant: LG Display Co., Ltd., Seoul (KR)

(72) Inventors: Changwoo Lee, Seoul (KR); Jeongtae Hwang, Paju-si (KR); Byungjae Lee, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/823,406

(22) Filed: Nov. 27, 2017

(65) Prior Publication Data

US 2018/0174522 A1 Jun. 21, 2018

(30) Foreign Application Priority Data

Dec. 19, 2016 (KR) ..... 10-2016-0173896

(51) Int. Cl.
*G09G 3/3275* (2016.01)
*G09G 3/3233* (2016.01)
(Continued)

(52) U.S. Cl.
CPC ..... *G09G 3/3275* (2013.01); *G09G 3/3233* (2013.01); *G09G 3/3258* (2013.01); *G09G 3/3291* (2013.01); *G09G 3/006* (2013.01); *G09G 2300/043* (2013.01); *G09G 2310/0259* (2013.01); *G09G 2320/0233* (2013.01); *G09G 2320/0693* (2013.01); *G09G 2330/12* (2013.01)

(58) Field of Classification Search
CPC ..... G09G 2300/043; G09G 2310/0259; G09G 2320/0233; G09G 2320/0693; G09G 2330/12; G09G 3/006; G09G 3/3233; G09G 3/3258; G09G 3/3275; G09G 3/3291
See application file for complete search history.

(56) References Cited

U.S. PATENT DOCUMENTS 9,349,311 B2 * 5/2016 Yu ..... G09G 3/006
9,601,051 B2 * 3/2017 Shin ..... G09G 3/3225
(Continued)

FOREIGN PATENT DOCUMENTS

| | | | |
|---|---|---|---|
| CA | 2694086 | A1 | 8/2011 |
| KR | 10-1549343 | B1 | 9/2015 |
| WO | WO 2005-004098 | A1 | 1/2005 |

OTHER PUBLICATIONS

Extended European Search Report, European Patent Application No. 17205650.9, dated May 9, 2018, 9 pages.

*Primary Examiner* — Dmitriy Bolotin
(74) *Attorney, Agent, or Firm* — Fenwick & West LLP

(57) ABSTRACT

The present disclosure provides a display device. The display device may comprise a display panel including a plurality of pixels, a reference current source providing a reference current, and a source drive IC including sensing units for sampling a signal input from the pixel through a sensing line and an ADC connected to the sensing units and obtaining sensing data related to a driving of the pixel. The source drive IC may further comprise a switch array connecting the sensing lines and the sensing units, and the switch array in each sensing unit may comprise a first switch for connecting a corresponding sensing unit to a first sensing line corresponding to the corresponding sensing unit and a second switch for connecting the corresponding sensing unit to a second sensing line adjacent and previous to the first sensing line or the reference current source.

10 Claims, 12 Drawing Sheets

(51) Int. Cl.

| | |
|---|---|
| ***G09G 3/3291*** | (2016.01) |
| ***G09G 3/3258*** | (2016.01) |
| *G09G 3/00* | (2006.01) |

(56) References Cited

U.S. PATENT DOCUMENTS

| | | | | |
|---|---|---|---|---|
| 9,805,646 | B2 * | 10/2017 | Park | G09G 3/3225 |
| 9,905,160 | B2 * | 2/2018 | Woo | G09G 3/3225 |
| 10,032,409 | B1 * | 7/2018 | Wu | G09G 3/3225 |
| 2013/0050292 | A1 * | 2/2013 | Mizukoshi | G09G 3/3291 345/690 |
| 2016/0012798 | A1 * | 1/2016 | Oh | G09G 3/325 345/205 |
| 2016/0078805 | A1 * | 3/2016 | Woo | G09G 3/3225 345/78 |
| 2017/0287390 | A1 * | 10/2017 | Lee | G09G 3/325 |

* cited by examiner

DISPLAY DEVICE

CROSS-REFERENCE TO RELATED APPLICATIONS

This application claims the benefit of priority under 35 U.S.C. § 119(a) to Republic of Korea Patent Application No. 10-2016-0173896 filed on Dec. 19, 2016, which is incorporated by reference herein in its entirety.

BACKGROUND

Field of Technology

The present disclosure relates to a display device, and more particularly, to a display device that calibrates the sensing circuit for sensing the characteristics of a display panel in real-time.

Discussion of the Related Art

An active matrix type organic light emitting display covers an organic light emitting diode (hereinafter, referred to as "OLED") which emits light by itself, and has advantages of a fast response speed, high light emitting efficiency, high brightness, and a wide viewing angle.

An OLED that emits light by itself includes an anode electrode, a cathode electrode, and organic compound layers formed therebetween. The organic compound layers include a hole injection layer HIL, a hole transport layer HTL, an emission layer EML, an electron transport layer ETL, and an electron injection layer EIL. When a driving voltage is applied to the anode electrode and the cathode electrode, holes passing through the HTL and electrons passing through the ETL are transferred to the EML to form excitons. As a result, the light emitting layer EML generates visible light.

In an organic light emitting diode display device, pixels each including an OLED are arranged in a matrix form, and luminance is controlled by controlling the amount of emitted light of the OLED according to the gradation of image data. Each of the pixels includes a driving element, i.e., a driving thin film transistor TFT, which controls the pixel current flowing the OLED according to the voltage applied between its gate electrode and the source electrode. The electrical characteristics of the OLED and the driving TFT deteriorate with time and may cause a difference in the pixels. Electrical deviations between these pixels are a major factor in degrading image quality.

The external compensation technology is known that measures the sensing information corresponding to the electrical characteristics of the pixels (the threshold voltage and the electron mobility of the driving TFT and the threshold voltage of the OLED) and modulates image data in an external circuit based on the sensing information, in order to compensate for the electrical characteristic deviation between the pixels.

In this external compensation technology, the electrical characteristics of pixels are sensed by using a sensing block embedded in a source drive IC (integrated circuit). The sensing block which receives pixel characteristic signals in the form of a current comprises a plurality of sensing units including a current integrator and a sample/hold unit, and an analog-to-digital converter ADC. The current integrator performs an integration of a pixel current input through a sensing channel to produce a sensed voltage. This sensed voltage is passed to the ADC through the sample/hold unit, and converted to digital sensing data by the ADC. A timing controller calculates a pixel compensation value for compensating for variations in the electrical characteristics of pixels based on the digital sensing data from the ADC, and corrects the input image data based on the pixel compensation value.

Since the organic light-emitting display comprises a plurality of source driver ICs for driving the display panel on an area basis in a segmented fashion, sensing blocks, each embedded in each source drive IC, sense the pixels on the display panel area by area in a segmented fashion. When pixels are sensed in a segmented fashion by the sensing blocks, sensing accuracy may be low due to offset variations between the sensing blocks. Especially, the ADC inside the source drive IC changes in its characteristics depending on a temperature or surrounding environments, so the output of the ADC maintains a constant value to some degree at a certain range of a room temperature, but at a high temperature outside the room temperature it changes to a value significantly different from that at the room temperature. This output characteristics of the ADC affect the pixel sensing data for the panel, causing a block dim phenomenon in which a difference in luminance is displayed between the areas where the source drive ICs are responsible when displaying an image.

To solve the block dim phenomenon, an offset deviation among the sensing blocks should be compensated through a calibration process. The calibration process applies a test current to each sensing block to obtain the sensing data for calibration and calculates the compensation values for calibration which can compensate for the offset deviation between the sensing blocks based on the sensing data for calibration. A timing controller increases compensation accuracy by referring to the compensation values for calibration as well as the compensation values for pixel when adjusting input image data.

FIGS. 1 and 2 show the configurations implementing conventional calibration operations.

The first conventional calibration method in FIG. 1 provides one common current source Ix in order to apply a test current to, for example, 3 sensing blocks equipped in 3 source drive ICs SIC1, SIC2 and SIC3. This calibration method sequentially applies the test current to the 3 sensing blocks while alternatively turning on the switches SW1, SW2 and SW3 connected between the common current source Ix and the source drive ICs SIC1, SIC2 and SIC3.

The second conventional calibration method in FIG. 2 provides 3 separate current sources I1, I2 and I3 in order to apply a test current to for example 3 sensing blocks equipped in 3 source drive ICs SIC1, SIC2 and SIC3. This calibration method simultaneously applies the test current to the 3 sensing blocks via the separate current sources I1, I2 and I3.

The first calibration method does not cause a calibration error by the deviation of the current sources because the common current source Ix is used, but has the problem of increasing a tack time because all source drive ICs SIC1, SIC2 and SIC3 are sequentially calibrated via one common current source Ix.

The second calibration method has the advantage of decreasing the tack time because the source drive ICs SIC1, SIC 2 and SIC3 are simultaneously calibrated via separate current sources I1, I2 and I3, but has the problem of causing the calibration error due to the deviation among the separate current sources I1, I2 and I3. In case that a number of source drive ICs are used in a display device, for example 20 source drive ICs are used, the number of separate current sources should be 20, and the circuit configuration of the current sources should become precise and complicated or a circuit scale would become large so that respective current sources can output the currents having a very small deviation and almost a same value.

Meanwhile, because an offset deviation occurs between sensing units corresponding to respective sensing channels, when calibration operations are performed for respective sensing units in order to calibrate the deviation of the sensing units, both of the first and second calibration methods have the problem of increasing the tack time. Especially, in the case of the first calibration method, the problem that the time required for the calibration operation is increased is the most serious.

SUMMARY

The present disclosure has been made in view of the above circumstances. It is an object of the present disclosure to provide the calibrating device and method for reducing a sensing time and eliminating a sensing deviation for each sensing channel.

It is another object of the present disclosure to provide the calibrating device for preventing the sensing deviation among channels from occurring by adding only a small resource and the display device including the calibrating device.

The display device according to an embodiment of the present disclosure may comprise a display panel including a plurality of pixels each of which is connected to one of a plurality of data lines and one of a plurality of sensing lines; a reference current source configured to provide a reference current; and a source drive IC, including a plurality of sensing units for sampling a signal input from the pixel through the sensing line and an analog-to-digital converter ADC connected to the plurality of sensing units, configured to provide a data voltage to the pixel through the data line, and obtain sensing data related to a driving of the pixel. The source drive IC may further comprise a switch array connecting the plurality of sensing lines and the plurality of sensing units, and the switch array in each sensing unit may comprise a first switch for connecting a corresponding sensing unit to a first sensing line corresponding to the corresponding sensing unit, and a second switch for connecting the corresponding sensing unit to a second sensing line adjacent and previous to the first sensing line or the reference current source.

In an embodiment, each sensing unit is connected to the first sensing line through the first switch to receive a first test current, and then connected to the second sensing line through the second switch to receive a second test current or connected to the reference current source through the second switch to receive the reference current, or each sensing unit is connected to the second sensing line through the second switch to receive a second test current or connected to the reference current source through the second switch to receive the reference current, and then connected to the first sensing line through the first switch to receive the first test current.

In an embodiment, a first sensing unit of a first source drive IC may be connected to the reference current source through the second switch.

In an embodiment, a first sensing unit of each source drive IC except for a first source drive IC may be connected to a sensing line corresponding to a last sensing unit of a source drive IC adjacent and previous to a corresponding source drive IC through the second switch.

In an embodiment, the source drive IC may obtain first calibration data corresponding to the first test current in a first period and obtain second calibration data corresponding to the second test current in a second period, for each sensing unit. Or, the source drive IC may obtain first calibration data corresponding to the second test current or the reference current in a first period and obtain second calibration data corresponding to the first test current in a second period, for each sensing unit.

In an embodiment, the display device may further comprise a timing controller configured to process the sensing data and the first and second calibration data output from the source drive IC. The timing controller may be configured to compare the first calibration data obtained by a first sensing unit in the first period and the second calibration data obtained by a sensing unit adjacent to the first sensing unit in the second period, and calculate a compensation data for correct a deviation between the sensing data obtained by the first sensing unit and the sensing data obtained by the second sensing unit.

In an embodiment, the first test current may be provided from a pixel connected to the first sensing line and disposed in a predetermined pixel line, or provided from a current source or a dummy pixel disposed in a non-display area and connected to the first sensing line. And, the second test current may be provided from a pixel connected to the second sensing line and disposed in the predetermined pixel line, or provided from a current source or a dummy pixel disposed in the non-display area and connected to the second sensing line.

In another embodiment of the present invention, the display device may include a plurality of sensing units for sampling a signal input through a sensing line connected to a pixel equipped in a display panel and an analog-to-digital converter ADC connected to the plurality of sensing units and obtaining sensing data related to a driving of the pixel, and the method for calibrating the display device may comprise, in a first period, integrating and sampling a first test current input from a first sensing line corresponding to a first sensing unit by the first sensing unit and converting the sampled value into a first calibration data by the ADC, and integrating and sampling a second test current input from a second sensing line corresponding to a second sensing unit adjacent and next to the first sensing unit by the second sensing unit and converting the sampled value into a second calibration data by the ADC; and in a second period, integrating and sampling a third test current input from a third sensing line adjacent and previous to the first sensing unit or a reference current input from a reference current source by the first sensing unit and converting the sampled value into a third calibration data by the ADC, and integrating and sampling the first test current input from the first sensing line by the second sensing unit and converting the sampled value into fourth calibration data by the ADC.

In an embodiment, when the display device includes a plurality of source drive IC comprising the plurality of sensing units and the ADC, a first sensing unit of a first source drive IC may be connected to the reference current source to receive the reference current and a first sensing unit of each source drive IC except the first source drive IC may be connected to a sensing line corresponding to a last sensing unit of a source drive IC adjacent and previous to a corresponding source drive IC to receive a test current, in the second period.

In an embodiment, the calibrating method may further comprise comparing the first calibration data obtained via the first sensing unit in the first period with the fourth calibration data obtained via the second sensing unit in the second period to extract a compensation value for correcting a deviation between sensing data obtained via the first sensing unit and sensing data obtained via the second sensing unit.

In yet another embodiment of the present invention, the display device may include a plurality of sensing units for sampling a signal input through a sensing line connected to a pixel equipped in a display panel and an analog-to-digital converter ADC connected to the plurality of sensing units and obtaining sensing data related to a driving of the pixel, and the method for calibrating the display device may comprise simultaneously connecting the sensing units to sensing lines corresponding to the sensing units, integrating and sampling a test current input from a connected sensing line at each sensing unit, and sequentially connecting the sensing units to the ADC to obtain first calibration data for respective sensing units; and connecting the sensing units to sensing lines adjacent sensing lines corresponding to the sensing units or a reference current source, integrating and sampling a test current input from a connected sensing line or a reference current input from the reference current source at each sensing unit, and sequentially connecting the sensing units to the ADC to obtain second calibration data for respective sensing units.

In an embodiment, the calibrating method may further comprise comparing the first calibration data and the second calibration data which are respectively obtained by a first sensing unit and a second sensing unit adjacent to the first sensing unit based on a same test current input from a same sensing line, to extract a compensation value for correcting a deviation between sensing data obtained via the first sensing unit and sensing data obtained via the second sensing unit.

Accordingly, by using only one reference current source, the deviation among sensing blocks or among source drive ICs as well as the deviation among sensing channels may be efficiently removed, thereby the block dim phenomenon can be prevented and image quality can be improved.

And, because providing only one reference current source outputting a current of an exact value, calibration operations can be performed using small resources.

Furthermore, the time required to perform the calibration operation for compensating for the deviation among sensing channels can be reduced.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
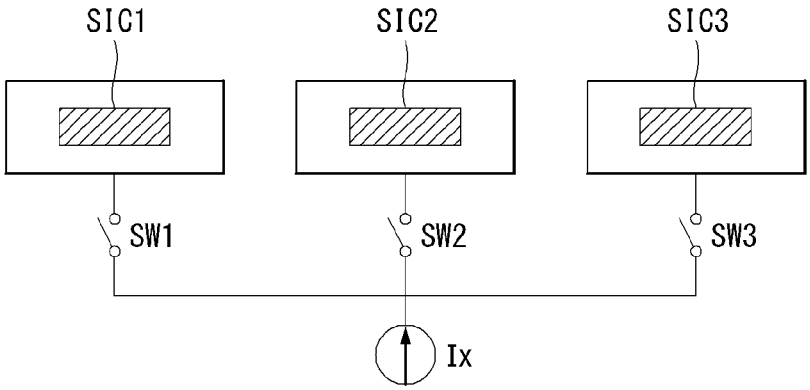
FIG. 1 shows the configuration implementing a first conventional calibration method.

Hereinafter, preferred embodiments of the present disclosure will be described in detail with reference to the accompanying drawings. Same reference numerals throughout the specification denote substantially identical components. In the following description, a detailed description of known functions and configurations incorporated herein will be omitted when it may make the subject matter of the present invention rather unclear.

A data driving circuit includes a plurality of source drive ICs, and each source drive IC comprises a sensing block including a plurality of sensing units and an analog-to-digital converter ADC to sense the driving characteristics of pixels included in a display panel. Due to the characteristic differences per ADC a block dim phenomenon occurs and due to the characteristic differences per sensing unit there are luminance differences in adjacent pixels displaying same luminance.

To solve the problem, the deviation of the ADCs included the sensing blocks should be measured and compensated and the detection deviation among respective sensing units should be measured and compensated. For example, source drive ICs are used in 4K display having a lateral resolution of 3840, and 192 sensing units are included in each source drive IC, so a same test current should be applied to each sensing unit, calibration data should be obtained via the ADC and compared with one another in order to compensate the deviation among the sensing units.

In case of adopting only one current source as the configuration in FIG. 1, there is a problem of taking much time to perform the calibrating operation for the deviation compensation between the sensing units. In case of adopting plural current sources as the configuration in FIG. 2, the time is required less than FIG. 1, but there is a problem that the cost is high to configure the circuit such that the test currents output from the current sources are maintained to be a same value.

The present disclosure reduces the time required for a calibrating operation by simultaneously providing a plurality of test currents corresponding to the number of the sensing line, and makes it possible to reduce the circuit construction cost while not separately using a plurality of reference current sources having a complicated circuit configuration and a large scale by receiving test currents from the pixels included in the display panel as current sources.

And, the present disclosure sequentially supplies the test currents generated in the pixels connected to sensing lines or the test currents generated in the current source having a simple circuit configuration and connected to a sensing line, to a corresponding sensing unit and an adjacent sensing unit, and compares the calibration data output via the sensing units and the ADC, so can eliminate not only the deviation between adjacent sensing units but also the deviation between the ADCs.

Furthermore, the present disclosure mounts one reference current source for outputting a current of a precise value on the display panel, sequentially supplies the test current output from the reference current source and the test current generated in the pixel connected to a corresponding sensing line to one sensing unit to respectively obtain calibration data, and compares the calibration data, thereby can reduce the occurrence of luminance deviation for each display device.

Figure 3:
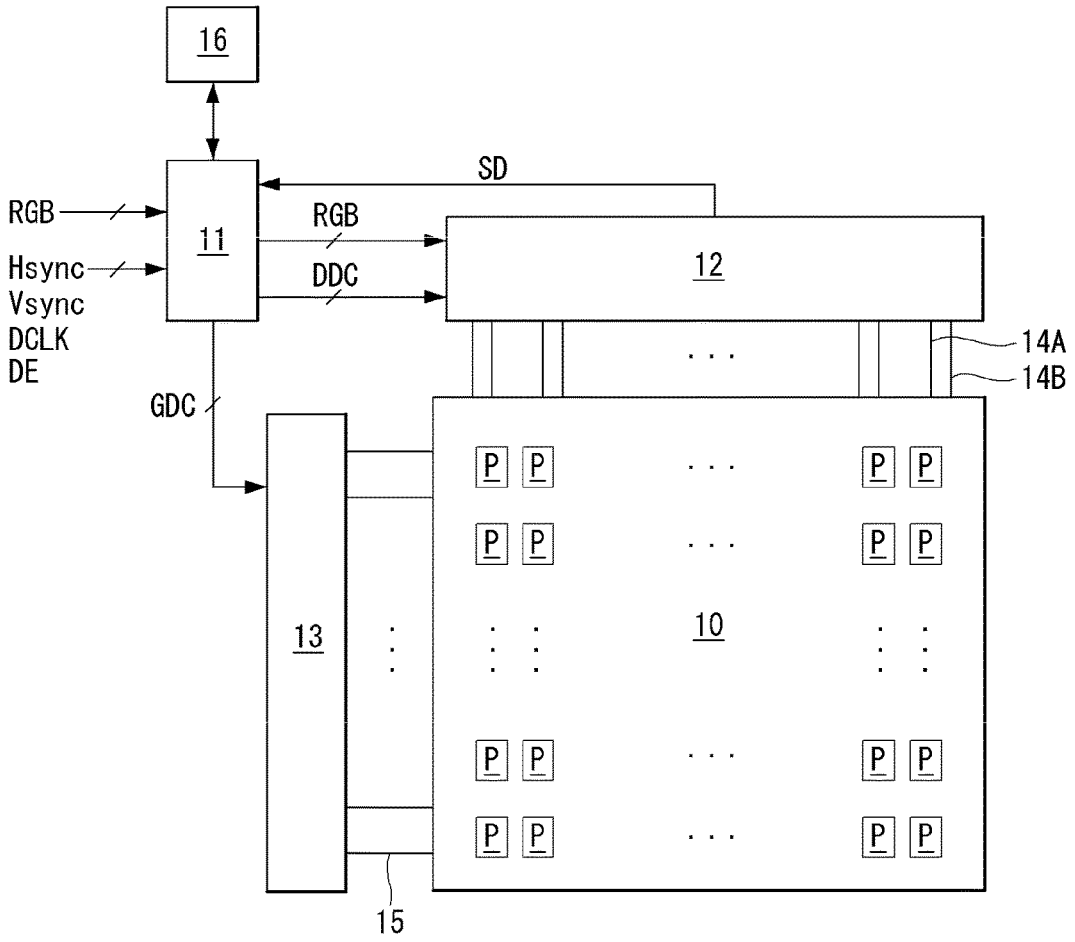
FIG. 3 shows a display device according to an embodiment of the present disclosure as blocks.
Figure 4:
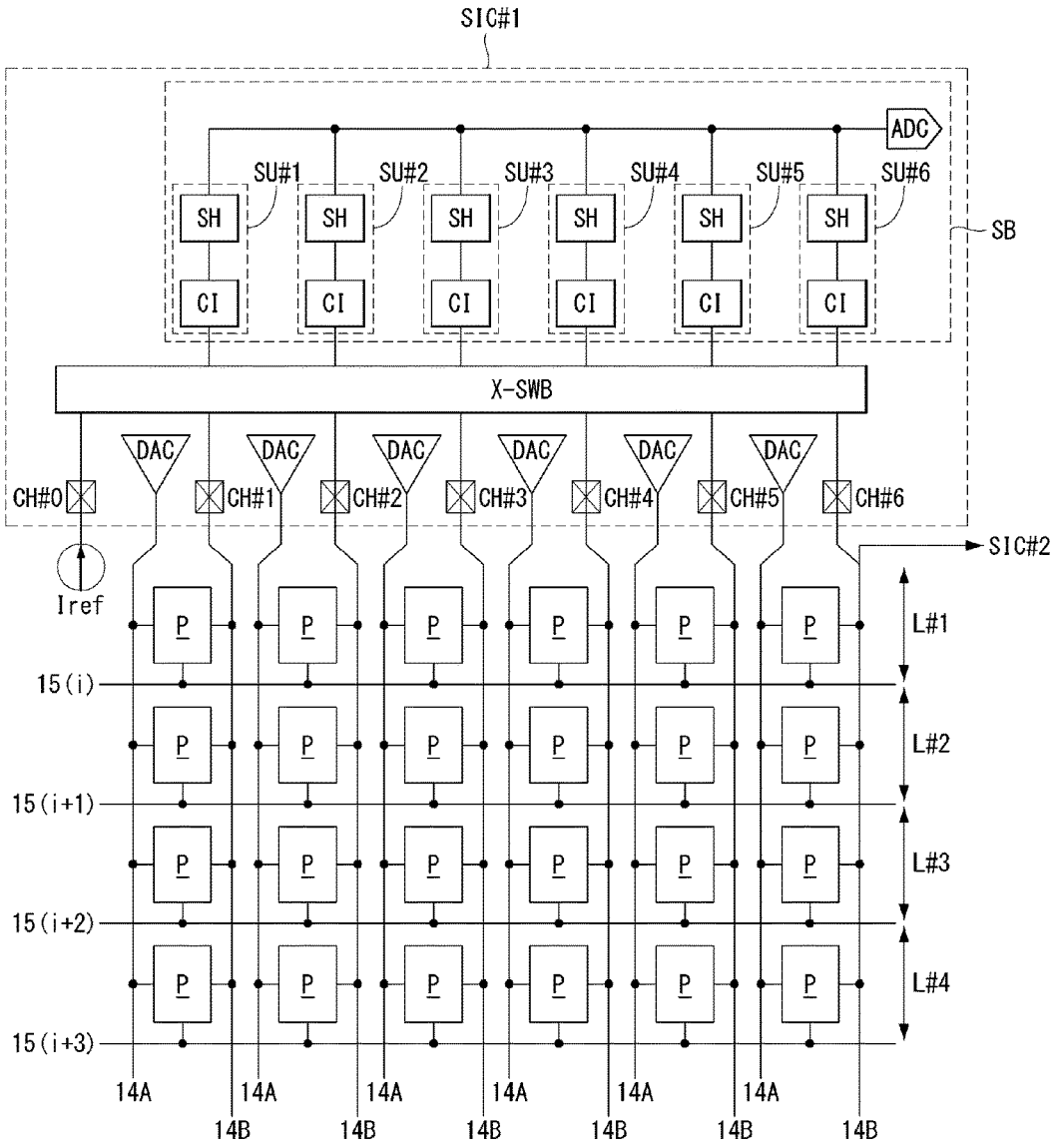
FIG. 4 shows the configurations of the display panel and a source drive IC for performing the calibration operation according to an embodiment of the present disclosure.

FIG. 3 shows a display device according to an embodiment of the present disclosure as blocks, and FIG. 4 shows the configurations of the display panel and a source drive IC for performing the calibration operation according to an embodiment of the present disclosure.

The display device according to the present disclosure comprises a display panel 10, a timing controller 11, a data driving circuit 12, a gate driving circuit 13 and a memory 16.

A plurality of data lines 14A and 14B and a plurality of sensing lines and a plurality of gate lines (or scan lines) 15 cross each other on the display panel 10, and the pixels P are arranged in a matrix form to constitute a pixel array. The plurality of gate lines 15 may include a plurality of first gate lines to which first scan signals are supplied.

In the pixel array, each pixel is connected to one of the data lines 14A, one of the sensing lines 14B, and one of the gate lines 15 and forms a pixel line L#n. Each pixel may be electrically connected to a data line 14A and receive a data voltage from the data line 14A in response to a gate pulse (or a scan pulse) fed through a gate line 15, and output a sensing signal through a sensing line 14B. The pixels arranged on a same pixel line L#n operate simultaneously according to a gate pulse applied from a same gate line.

The pixel is supplied with a high potential drive voltage EVDD and a low potential drive voltage EVSS from a not-shown power supply, and may comprise an OLED, a driving TFT, a storage capacitor, a plurality of switch TFTs. The TFTs constituting the pixel may be implemented as a p-type or an n-type or as a hybrid type in which p-type and n-type are mixed. In addition, the semiconductor layer of the TFTs may include amorphous silicon, polysilicon, or an oxide.

In the driving circuit or the pixel of the present disclosure, the switch elements may be implemented by the transistor of a n-type Metal Oxide Semiconductor Field Effect Transistor MOSFET or a p-type MOSFET. The following embodiments are illustrated with the n-type transistor, but the present disclosure is not limited thereto. A transistor is the element of 3 electrodes including a gate, a source and a drain. The source is an electrode for supplying a carrier to the transistor. Within the transistor the carrier begins to flow from the source. The drain is an electrode from which the carrier exits the transistor. That is, the flow of carriers in the MOSFET is from the source to the drain. In the case of an N-type MOSFET (NMOS), since the carrier is an electron, the source voltage has a voltage lower than the drain voltage so that electrons can flow from the source to the drain. In the N-type MOSFET, a current direction is from the drain to the source because electrons flow from the source to the drain. In the case of a P-type MOSFET (PMOS), since the carrier is a hole, the source voltage is higher than the drain voltage so that holes can flow from the source to the drain. In the P-type MOSFET, a current flows from the source to the drain because holes flow from the source to the drain. It should be noted that the source and drain of the MOSFET are not fixed. For example, the source and drain of the MOSFET may vary depending on the applied voltage. In the following embodiments, the disclosure should not be limited due to the source and drain of the transistor.

The present disclosure may be applied to the display device using an external compensation technique (scheme or method). The external compensation technique senses the electrical characteristics of the driving TFT equipped in the pixel and corrects the digital data of input image based on a sensing value. The electrical characteristics of the driving TFT may include the threshold voltage and the electron mobility of the driving TFT.

The timing controller 11 may temporally separate the sense driving, which senses the driving characteristics of the pixel and updates the compensation value corresponding to a sensing value, and the display driving or a display operation which writes image data to the display panel in order to display the input image reflecting the compensation value, according to a predetermined control sequence. The sense operation may be performed during a period in which the writing of image data is stopped.

Under the control of the timing controller 11, the sense driving may be performed at a vertical blank period, or during a power-on sequence period before the display operation starts (a non-display period until an image display period in which image is displayed immediately after system power is applied), or during a power-off sequence after the display operation ends (a non-display period until the system power is turned off immediately after the image display is terminated).

The vertical blank period is a period during which input image data is not written and disposed between vertical active periods during which input image data of 1 frame is written. The power-on sequence period means a transient period from when the system power is turned on until the input image is displayed. The power-off sequence period means a transient period from the end of the display of the input image until the system power is turned off The present disclosure may further include a calibration driving for measuring the characteristic differences for respective sensing units and the characteristic differences for respective ADCs and compensating for the differences, in addition to the display driving and the sense driving. The calibration driving according to the present disclosure may be performed at the time of product shipment and may be further performed during the power-off sequence period, because it is time consuming by applying two test currents to each sensing unit in a unit of the source drive IC.

The timing controller 11 generates the data control signal DDC for controlling the operation timings of the data driving circuit 12 and the gate control signal GDC for controlling the operation timings of the gate driving circuit 13, based on timing signals, such as a vertical synchronization signal Vsync, a horizontal synchronization signal Hsync, a dot clock signal DCLK, and a data enable signal DE. The timing controller 11 may temporally separate the period of performing an image display and the period of performing the external compensation operation and differently generate the control signals for the image displaying and the control signals for the external compensating.

At the time of the calibration driving, the timing controller 11 may calculate the compensation values for calibrating, which can compensate for the offset deviation among the sensing blocks and the offset deviation among the sensing units, based on the data for calibration sent from the data driving circuit 12, and store them in the memory 16.

During the sense driving, the timing controller 11 may calculate the compensation values for pixels, which can compensate for the change of the driving characteristics of the pixels, based on the digital sensing values SD input from the data driving circuit 12 and store them in the memory 16. The compensation values for pixels stored in the memory can be updated every time the sense driving is performed, and thus the time-varying characteristics of the pixels can be easily compensated.

During the display driving, the timing controller 11 may read the compensation values from the memory 16, correct the digital data DATA of input image based on the compensation values, and provides it to the data driving circuit 12. The timing controller 11 can increase the compensation accuracy by further referring to the compensation values for calibration as well as the compensation values for pixels.

The data driving circuit 12 may include one or more source drive ICs SDICs for dividing and driving the display panel 10 on an area basis. Each source drive IC may comprise a plurality of digital-to-analog converters DACs connected to the data lines 14A, a sensing block SB connected to the sensing lines 14B through sensing channels and a cross switching block X-SWB for controlling the connection between the sensing lines 14B and sensing units.

Each sensing unit is commonly connected to a plurality of pixels Ps disposed in one pixel line L#n through sensing lines 14B. One unit pixel comprising two or more pixels, for example 4 pixels may share one sensing line 14B to be connected to a corresponding sensing unit.

The DAC converts the digital image data RGB input from the timing controller 11 into the data voltage for display according to the data control signal DDC and provides the data voltage to the data lines 14A. The data voltage for display is a voltage that varies depending on the gray level of the input image.

During the sense driving, the DAC generates the data voltage for sensing according to the data control signal DDC and provides the data voltage to the data lines 14A. The data voltage for sensing is a voltage that can turn on the driving TFT equipped in the pixel during the sense driving. The data voltage for sensing may be generated as a same value for all pixels. Given that the pixel characteristics are different for each color, the data voltage for sensing may be generated with different values for each color.

During the calibration driving, the DAC generates the data voltage for calibration according to the data control signal DDC and provides the data voltage to the data lines 14A. The data voltage for calibration is a voltage that can turn on the driving TFT equipped in the pixel during the sense driving to flow the test current for calibration to the sensing line 14B.

The data driving circuit may apply the data voltage for calibration to only one pixel, and not apply any data voltage or apply the data voltage enough to turn off the driving TFT to other pixels, among a plurality of pixels disposed in a same pixel line and connected to a same sensing line 14B.

The sensing block SB may comprise a plurality of sensing units SUs as many as sensing channels and one ADC. The sensing unit may comprise a current integrator CI connected to a sensing channel and integrating the current input through the sensing channel and a sample/hold unit SH for sampling the integrated current value. The ADC may be sequentially connected to respective sensing units and convert the sampled value into sensing data or calibration data. FIG. 4 illustrates that a first source drive IC SIC#1 includes 6 sensing units SU#1~SU#6.

The cross switching block X-SWB is a switch array comprising a plurality of switches selectively connecting the sensing unit to a sensing channel (or a sensing line) or a reference current source Iref, according to the data control signal DDC. The cross switching block X-SWB may connect each sensing unit to a corresponding sensing channel during the sense driving, and connect each sensing unit to two adjacent sensing channel sequentially.

That is, the cross switching block X-SWB may connect each sensing unit to a corresponding sensing channel, and then to a previous or next sensing channel that is neighboring the corresponding sensing channel, during the calibration driving. And, the cross switching block X-SWB may connect a first sensing unit SU#1 to a first sensing line through a first sensing channel CH#1 and then to the reference current source Iref or to the last sensing line of a previous source drive IC through $0^{th}$ sensing channel, during the calibration driving. In FIG. 4, the last sensing line of a first source drive IC SIC#1 may be connected to the first sensing unit SU#1 of a second source drive IC SIC#2.

The ADC outputs the sensing data corresponding to the driving characteristics of a pixel during the sense driving and outputs the calibration data corresponding to a test current or a reference current during the calibration driving.

The gate driving circuit 13 generates the scan signals for display based on the gate control signal GDC and sequentially provides the scan signals to the gate lines 15 connected to the pixel lines, during the display driving. The pixel line L#n means a set of horizontally adjacent pixels. The gate driving circuit 13 generates the scan signals for sensing based on the gate control signal GDC and sequentially provides the scan signals to the gate lines 15 connected to the pixel lines, during the sense driving.

The gate driving circuit 13 generates the scan signal for sensing based on the gate control signal GDC and provides the scan signal to one predetermined pixel line 15 in order for the pixels disposed in the pixel line to provide test currents to sensing lines 14B, during the calibration driving.

The timing controller 11 may compare two calibration data output from two adjacent sensing units which in turn receive a same test current from a same sensing line and calculate a correction value which can compensate for .the deviation between the two sensing units. Similarly, the timing controller 11 may compare two calibration data output from two adjacent sensing units which in turn receive a same test current from a next sensing line and calculate a correction value which can compensate for the deviation between the two sensing units.

As described above, the timing controller 11 may compensate for the characteristic deviation between all the sensing units included in all the source drive ICs by sequentially compensating for the deviation between neighboring sensing units. Also, the timing controller 11 may compare the calibration data by a test current source with the calibration data by the test current of a first sensing line of a first source drive IC to correct the deviation between display devices. Thus, timing controller 11 may calculate the compensation data for calibration values which can compensate for the deviation between sensing units, the deviation of sensing blocks and the deviation between display devices using the calibration data and store them in the memory 16.

The memory 16 stores a reference value for the calibration data into which the reference current input from the reference current source and flowing through the sensing unit is converted by the ADC. When the reference current is input to the first sensing unit of the first source drive IC and calibration data is output, the timing controller 11 may determine the reference compensating value for compensating for the first sensing unit of the first source drive IC by comparing the calibration data with the reference value stored in the memory 16.

As described above, the timing controller 11 determines the compensating values for correcting the deviation between sensing units by comparing two calibration data according to the test current applied to two adjacent sensing units from a sensing line, and determines the compensation value for correcting a predetermined sensing unit by a reference current, so may obtain the result of correcting all sensing units by the reference current.

The OLED display device will be mainly described as a display device to which the present disclosure is applied, but the display device of the present disclosure is not limited thereto. For example, the display device of the present disclosure can be applied to any display device, for example, a liquid crystal display LCD or an inorganic light emitting display device using an inorganic substance as a light emitting layer, which needs to sense driving characteristics of pixels in order to increase the reliability and life of the display device.

Figure 5:
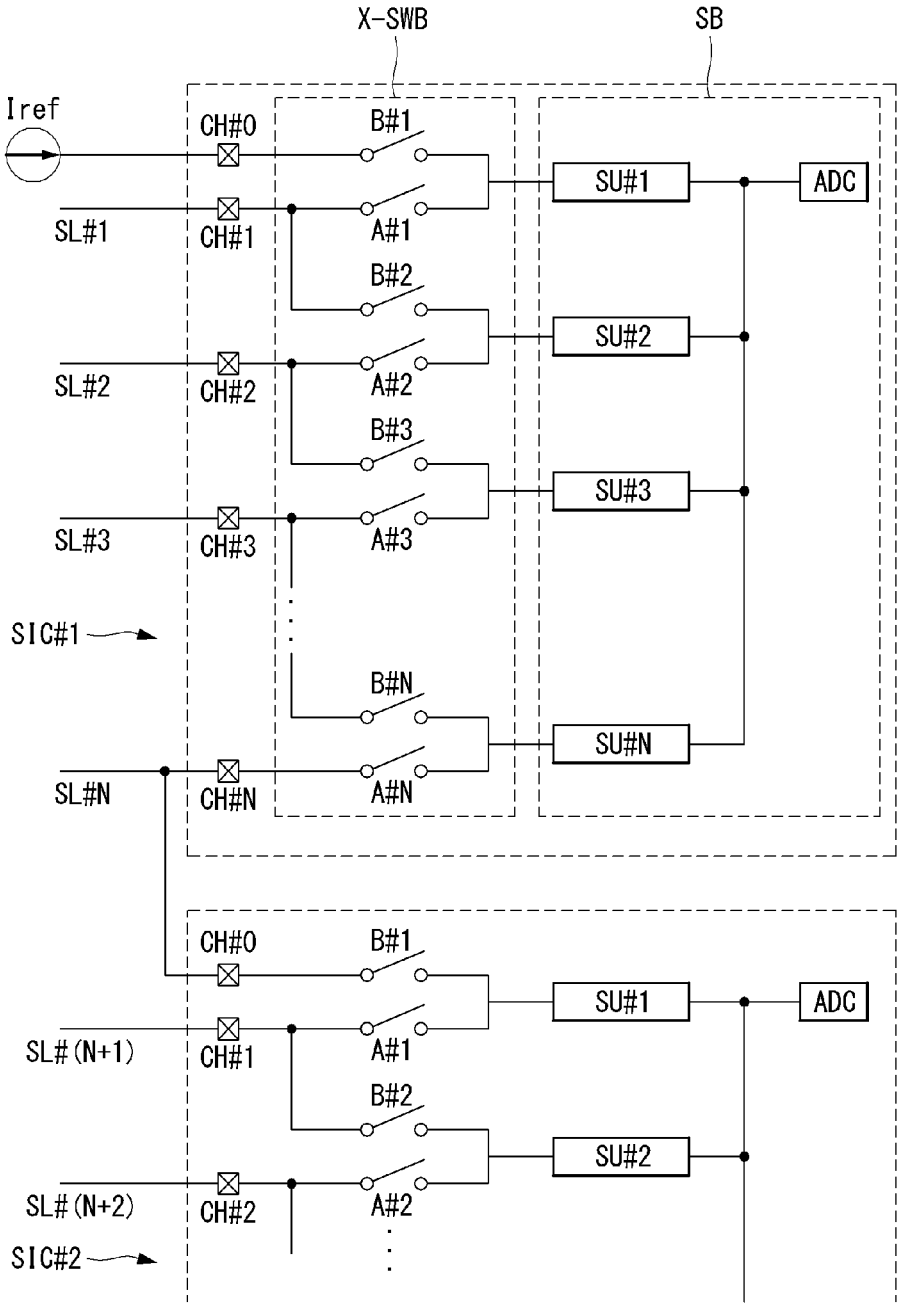
FIG. 5 shows the connections of a reference current source, the sensing lines providing a reference current to each channel, and sensing units according to an embodiment of the present disclosure.
Figure 6:
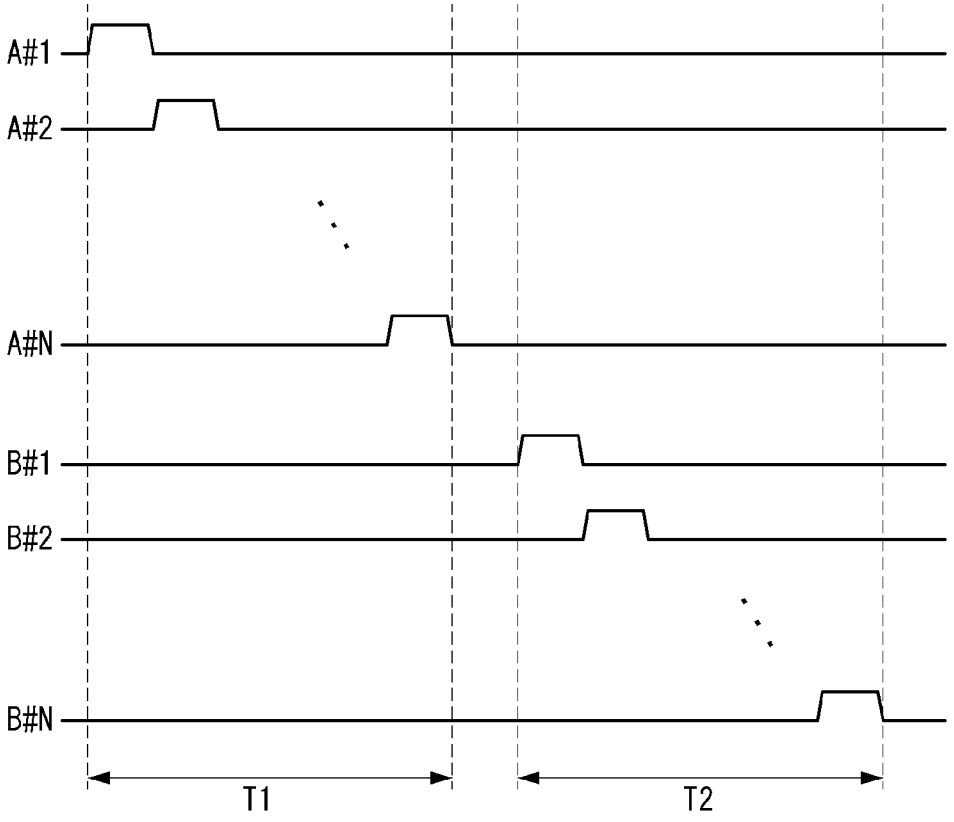
FIG. 6 shows the timings of the control signals for controlling the operations of the switches in the switching blocks included in the source drive ICs of FIG. 5 according to an embodiment.

FIG. 5 shows the connections of a reference current source, the sensing lines providing a reference current to each channel, and sensing units, and FIG. 6 shows the timings of the control signals for controlling the operations of the switches in the switching blocks included in the source drive ICs of FIG. 5 according to an embodiment.

The cross switching block X-SWB is equipped with first switches A and second switches B, that is comprises N switch pairs for N sensing units each of which includes a switch pair A and B, so may connect each pair of sensing units to a corresponding sensing line or a previous sensing line adjacent to the corresponding sensing line.

The first switches A connects a sensing unit to a corresponding sensing line, and the second switches B connects the sensing unit to a previous sensing line adjacent to the corresponding sensing line or a reference current source.

In FIG. 5, the first sensing unit SU#1 in the first source drive IC SIC#1 may be connected to or disconnected from the first sensing line SL#1 through the first sensing channel CH#1 by the first switch A#1, and connected to or disconnected to the reference current source Iref through $0^{th}$ sensing channel CH#0 by the second switch B#1.

And, the second sensing unit SU#2 is connected to the second sensing line SL#2 through the second sensing channel CH#2 by the second switch A#2 and connected to the first sensing line SL#1 through the first sensing channel CH#1 by the second switch B#2.

Meanwhile, explaining it based on the sensing line, k-th sensing line SL#k may be connected to a corresponding sensing unit SU#k through the switch pair A#k and B#(k+1)) included in the cross switching block X-SWB and then connected to a next sensing unit SU#(k+1).

The last, that is the N-th sensing line SL#N of the first source drive IC SIC#1 is connected to the corresponding N-th sensing unit SU#N by the first switch A#N, and then connected to the sensing unit (the first sensing unit SU#1 of the second source drive SIC#2) corresponding to (N+1)-th sensing line SL#(N+1) which is disposed adjacent and next to the N-th sensing line SL#N by the second switch B#1 included in the cross switching block X-SWB of the next source drive IC SIC#2.

During the calibration driving, since test currents are provided to sensing units through respective sensing lines and the same test current from one sensing line is in turn applied to two adjacent sensing units, the characteristic difference between two sensing units can be corrected by using the calibration data output from the two sensing units for the same test current.

As shown in FIG. 6, during a first period T1, the first switches A#1~A#N are sequentially turned on, so the test current of each sensing line is applied to a corresponding sensing unit. That is, during the first period T1, the switch A#1 connects the first sensing line SL#1 to the first sensing unit SU#1 to supply the test current of the first sensing line SL#1 to the first sensing unit SU#1, then the second switch A#2 connects the second sensing line SL#2 to the second sensing unit SU#2 to supply the test current of the second sensing line SL#2 to the second sensing unit SU#2, and similarly the switch A#N connects the N-th sensing line SL#N to the N-th sensing unit SU#N. The first switches A#1 to A#N are sequentially turned on in all the source drive ICs in the first period T1 to connect each sensing line to the corresponding sensing unit.

During a second period T2, the second switches B#1 to B#N are sequentially turned on to apply the test current of each sensing line to a next sensing unit adjacent to a corresponding sensing unit. That is, during the second period T2, the switch B#1 connects the reference current source Iref to the first sensing unit SU#1 to supply the reference current, the switch B#2 connects the first sensing line SL#1 to a next sensing unit (the second sensing unit SU#2) adjacent to the corresponding first sensing unit SU#1 to supply the test current of the first sensing line SL#1 to the second sensing unit SU#2, and similarly, the switch B#N connects the (N−1)-th sensing line SL#(N−1) to the N-th sensing unit SU#N. The second switches B#1 to B#N are sequentially turned on in all the source drive ICs in the second period T2 to connect each sensing line to the next sensing unit adjacent to the corresponding sensing unit.

Differently from FIG. 6, during the first period the second switches B#1 to B#N are sequentially turned on then during the second period the first switches A#1 to A#N are sequentially turned on. Of course, instead of sequentially turning on the first and second switches from A#1 to A#N and from B#1 to B#N, the first switches and the second switches may be turned on sequentially from A#N to A#1 and B#N to B#1.

Figure 7:
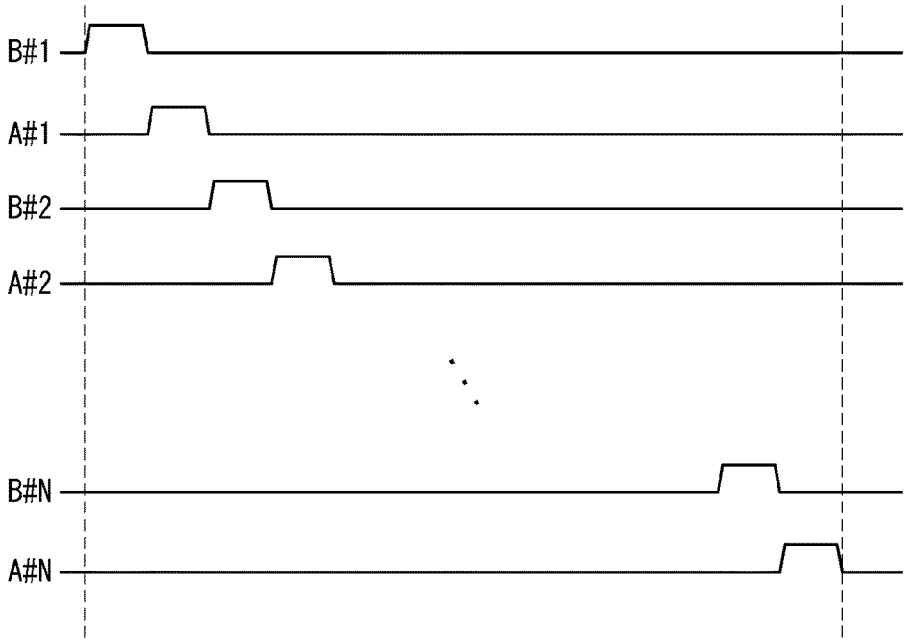
FIG. 7 shows the timings of the control signals for controlling the operations of the switches in the switching blocks included in the source drive ICs of FIG. 5 according to another embodiment.

FIG. 7 shows the timings of the control signals for controlling the operations of the switches in the switching blocks included in the source drive ICs of FIG. 5 according to another embodiment.

In FIG. 7, the sensing units are connected to sensing lines or the reference current source in order of the sensing unit number, for example in order of the first sensing unit SU#1, the second sensing unit SU#2, . . . , and N-th sensing unit SU#N. Each sensing unit SU#k first is connected, through the second switch B#k, to the sensing line SL#(k−1) positioned adjacent and previous to the sensing line SL#k corresponding to the sensing unit SU#k, and then connected, through the first switch A#k, to the corresponding sensing line SL#k.

That is, as shown in FIG. 7, the first and second switches included in the cross switching block X-SWB can be made to operate such as the second switch B#1 connected to the first sensing unit SU#1 is turned on, the first switch A#1 connected to the first sensing unit SU#1 is turned on, the second switch B#2 connected to the second sensing unit SU#2 is turned on, and the second switch A#2 connected to the second sensing unit SU#2 is turned on.

Or, in FIG. 7, the order of the first switch and the second switch is changed, the first and second switches can operate in order of A#1->B#1->. . . ->A#N->B#N.

Or, similar to what are explained by referring to FIG. 6 and contrary to the order shown in FIG. 7, the operations of the first and second switches may be controlled in order of A#N->B#N->. . . ->A#1->B#1 or in order of B#N->A#N->. . . ->B#1->A#1.

In FIG. 7, the first period and the second period may be established based on each sensing unit. For k-th sensing unit SU#k, in the first period, the second switch B#k operates to apply the test current from a previous sensing line SL#(k−1) to the k-th sensing unit SU#k, and in the second period, the first switch A#k operates to apply the test current from the sensing line SL#k corresponding to the k-th sensing unit SU#k to the k-th sensing unit SU#k.

Or, in FIG. 7, the first period and the second period may be established based on each sensing line. For k-th sensing line SL#k, in the first period, the first switch A#k operates such that the k-th sensing line SL#k applies a test current to a corresponding k-th sensing unit SU#k, and in the second period, the second switch B#(k+1) operates such that the k-th sensing line SL#k applies a test current to the sensing unit SU#(k+1) adjacent and next to the k-th sensing unit SU#k corresponding to the k-th sensing line.

When being connected to a sensing line or a reference current source to receive a test current or a reference current, the sensing unit integrates the current and samples the integrated value, and then the ADC converts it into calibration data to send to the timing controller. Since a plurality of sensing units are connected to one ADC, the sensing units connected to sensing lines and receive test currents are sequentially connected to the ADC.

Figure 8:
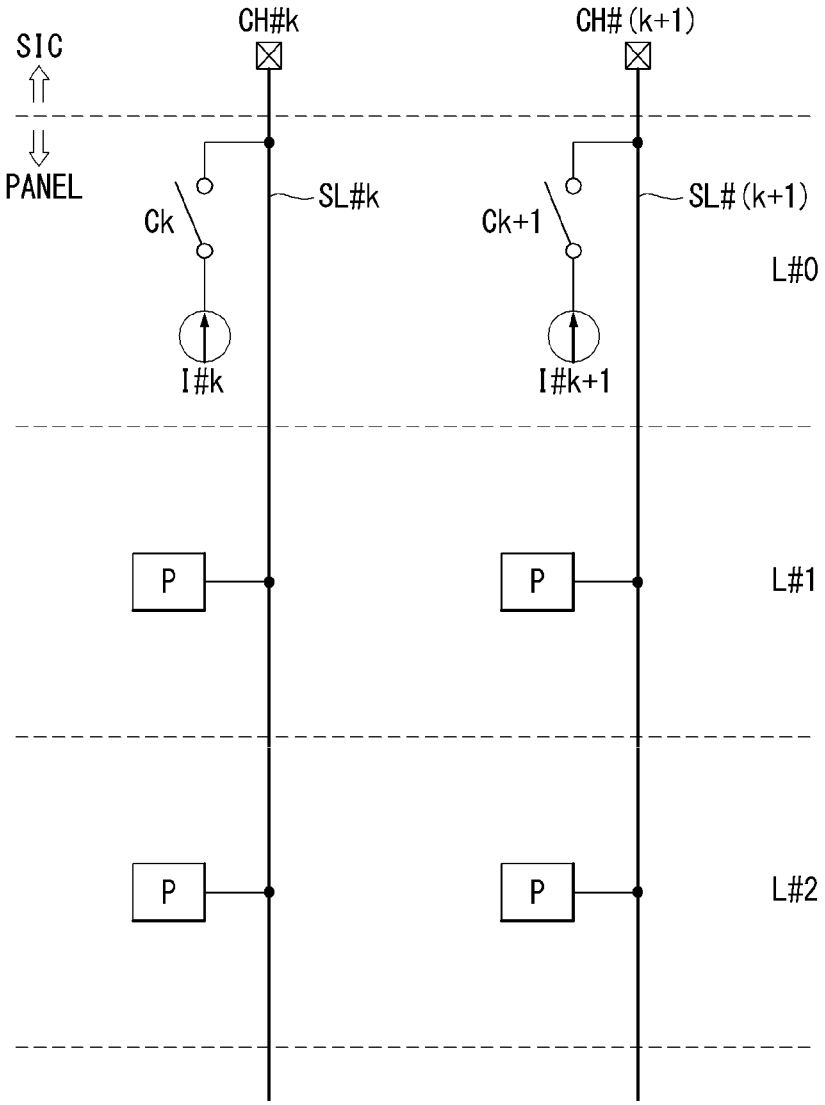
FIG. 8 shows an embodiment in which a separate current source is equipped in each channel for calibration operations.

During the calibration driving, each sensing line serves as a passage through which the test current is supplied. For each sensing line, one pixel among a plurality of pixels disposed in a pixel line and sharing a corresponding sensing line may play the role of the current source providing the test current. Or, a dummy pixel connected to each sensing line may be equipped in the non-display area outside a display area, and operate as the current source providing the test current during the calibration driving. Or, as shown in FIG. 8, a separate current source (I#k, I#k+1) may be equipped for each sensing line (or sensing channel) in the non-display area (in a pixel line L#0), and operate only during the calibration driving. The connection of the separate current sources and sensing lines may be controlled via switches (Ck, Ck+1).

Figure 9:
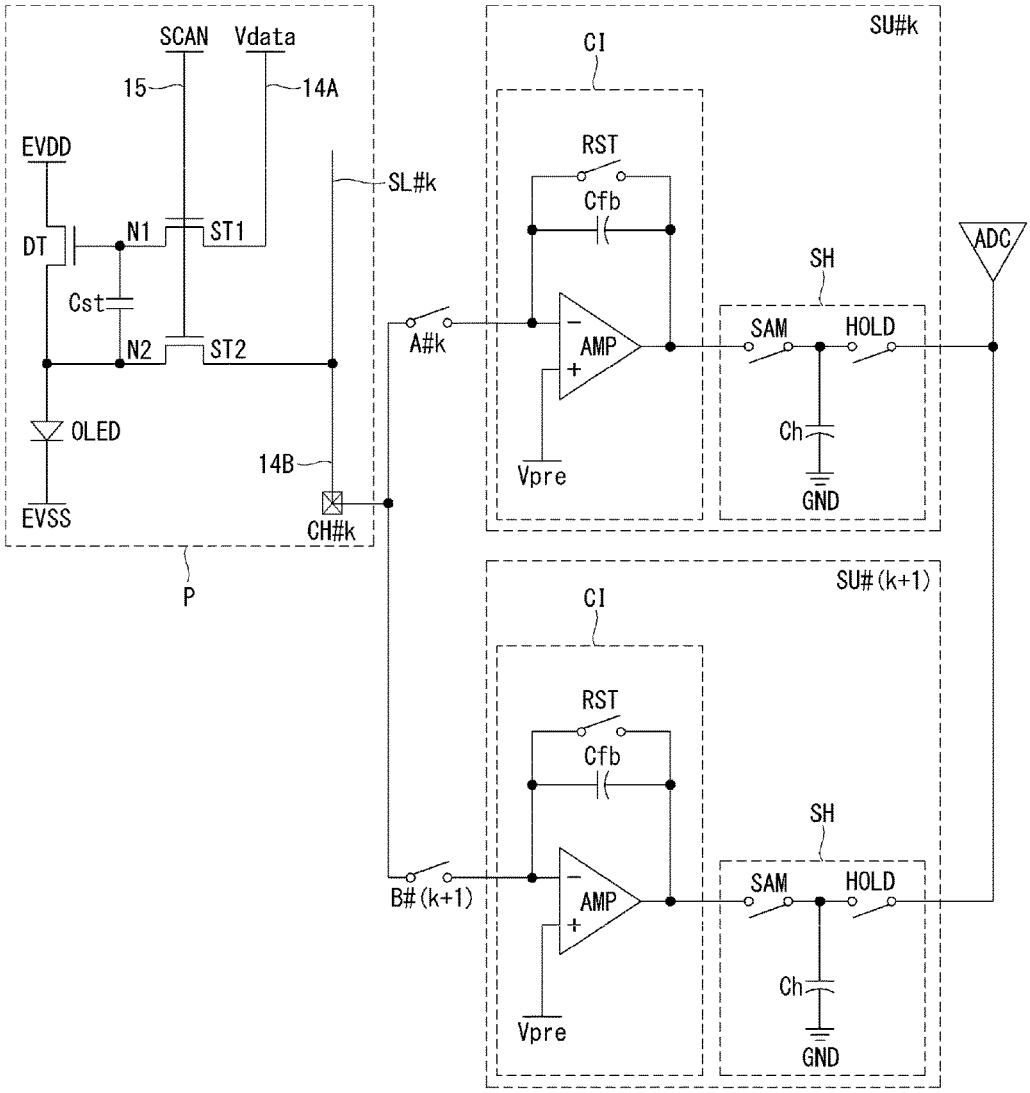
FIG. 9 shows the circuit configuration in which two adjacent sensing units are connected to one sensing line into which a test current flows according to an embodiment.

FIG. 9 shows the circuit configuration in which two adjacent sensing units are connected to one sensing line into which a test current flows.

Referring FIG. 9, the pixel of the present disclosure may be equipped with an OLED, a driving TFT DT, a storage capacitor Cst, a first switch ST1 and a second switch ST2.

The OLED includes an anode electrode connected to the source node of the driving TFT DT, an cathode electrode connected to the input terminal of a low potential drive voltage EVSS and organic compound layers located between the anode electrode and the cathode electrode. The driving TFT DT controls the amount of the current input to the OLED according to the voltage Vgs between a gate electrode and a source electrode. The gate electrode of the driving TFT DT is connected to a gate node N1, the drain electrode of the driving TFT DT is connected to the input terminal of a high potential drive voltage EVDD, and the source electrode of the driving TFT DT is connected to the source node N2. The storage capacitor Cst connects the gate node N1 and the source node N2. The first switch ST1 applies the data voltage Vdata in the data line 14A to the gate node N1 in response to the scan signal SCAN. The gate electrode of the first switch ST1 is connected to the gate line, the drain electrode of the first switch ST1 is connected to the data line 14A and the source electrode of the first switch ST1 is connected to the gate node N1. The second switch ST2 turns on/off the current flow between the source node N2 and the sensing line 14B in response to the scan signal SCAN. The gate electrode of the second switch ST2 is connected to the gate line, the drain electrode of the second switch ST2 is connected to the sensing line 14B and the source electrode of the second switch ST2 is connected to the source node N2.

The source drive IC constituting the data driving circuit 12 is connected to the pixels through the sensing lines 14B. The source drive IC may comprise a plurality of sensing units including a current integrator CI for integrating an analog sensing current (or an analog pixel current) during the sense driving or the test current or the reference current during the calibration driving and a sample/hold unit SH for sampling and holding the integrated current value, and an ADC for converting the sampling value into digital sensing data or digital calibration data.

The source drive IC may further comprise a first switch A for connecting a sensing unit to a corresponding sensing line and a second switch B for connecting a sensing unit a sensing line adjacent to a corresponding sensing line. In FIG. 9, k-th sensing line SL#k is connected to k-th sensing unit SU#k via the first switch A#k, and connected to (k+1)-th sensing unit SU#(k+1) via the second switch B#(k+1).

The current integrator comprises an operational amplifier AMP, a feedback capacitor Cfb and a reset switch RST. The current integrator integrates a pixel current, a test current or a reference current input to the sensing block through the sensing line 14B and outputs the integral value. The operational amplifier AMP includes an inverting terminal (−) receiving the pixel current or the test current, a non-inverting terminal (+) receiving a predetermined voltage Vpre and an output terminal outputting the integral value. The feedback capacitor Cfb connects the inverting terminal (−) and the output terminal and accumulates the current. The reset switch RST is connected to both ends of the feedback capacitor Cfb and the feedback capacitor Cfb is initialized when the reset switch RST is turned on.

The sample/hold unit comprises a sampling switch SAM, a holding capacitor Ch and a holding switch HOLD. If the sampling switch SAM is turned on, the output of the current integrator CI is stored in the holding capacitor Ch, and if the holding switch HOLD is turned on, the voltage stored in the holding capacitor Ch is applied to the ADC.

The ADC converts an analog output into digital sensing data or calibration data to output it.

Figure 10:
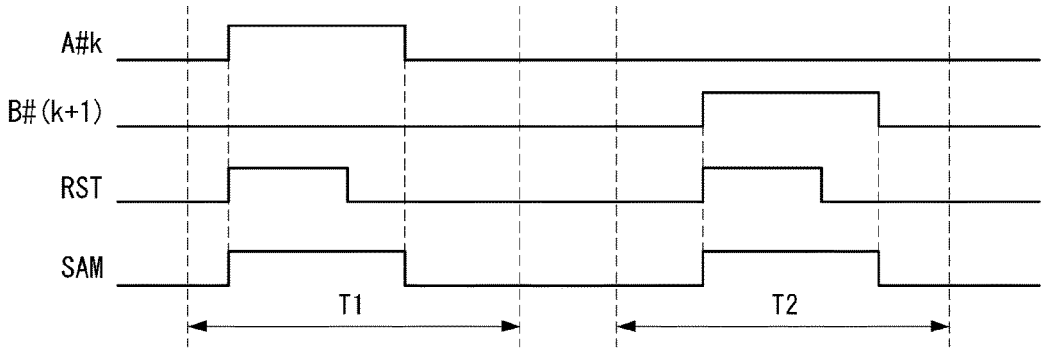
FIG. 10 shows the timings of the control signals for controlling the switches included in the circuit configuration of FIG. 9 according to an embodiment.
Figure 11:
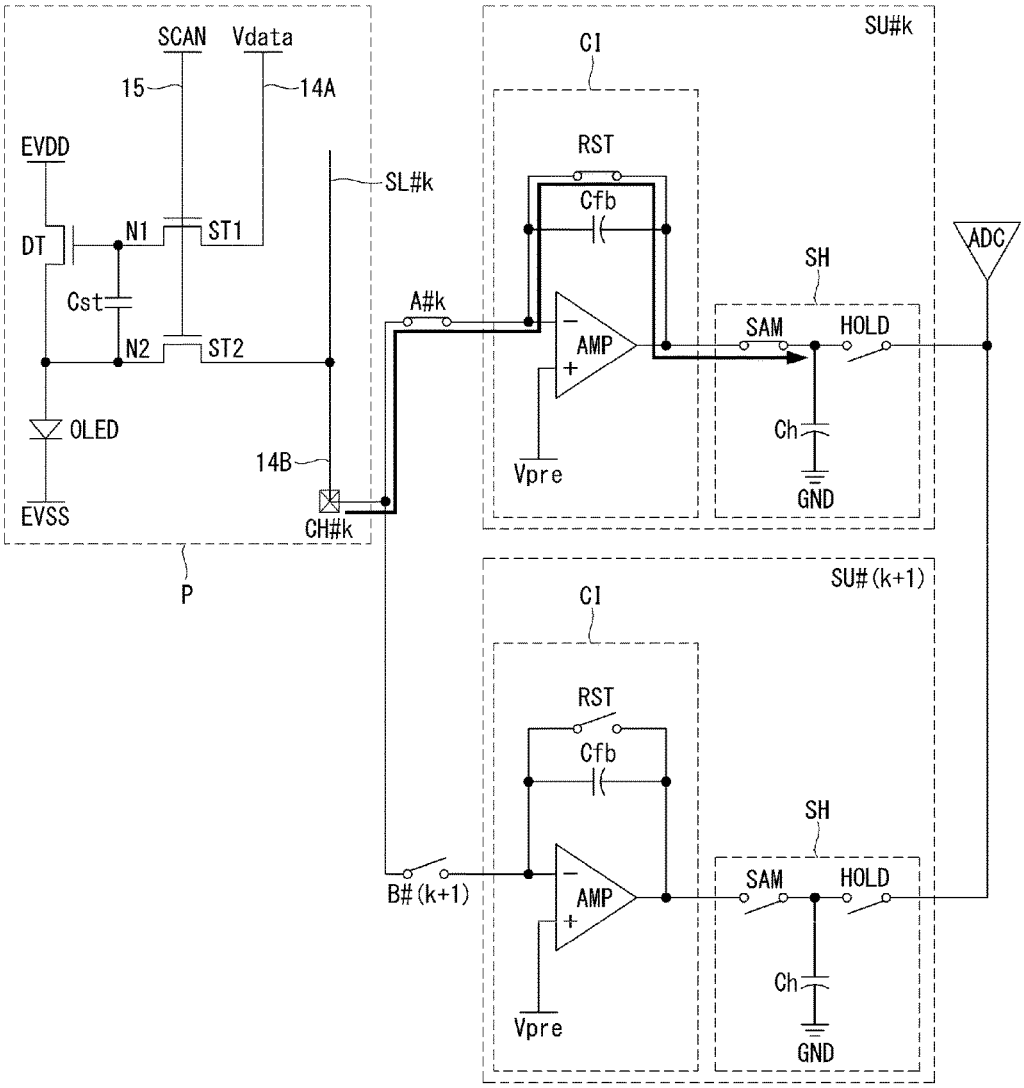
FIG. 11 shows the operations of a switching block and sensing units performed during the first period of FIG. 10 according to an embodiment.
Figure 12:
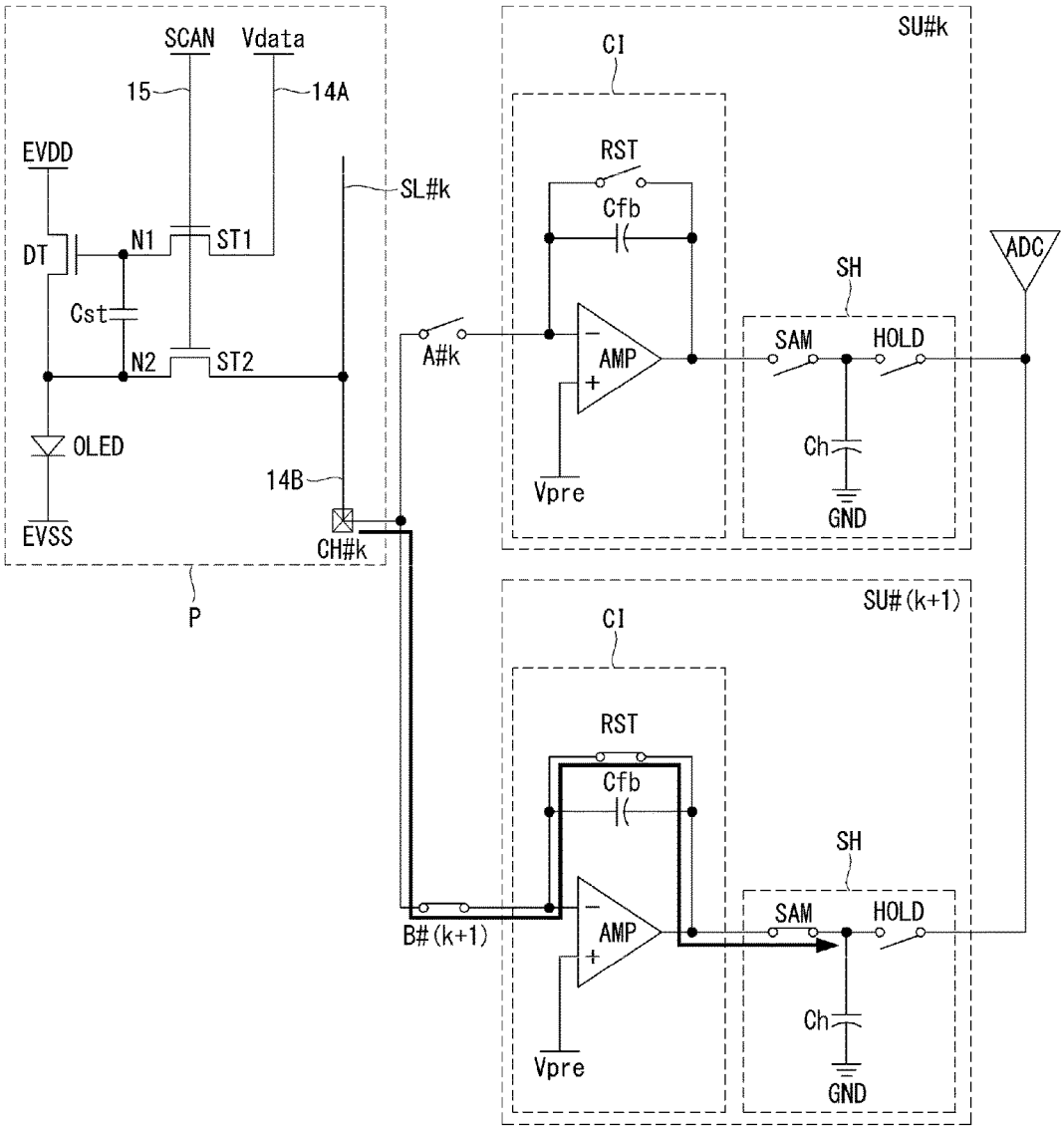
FIG. 12 shows the operations of the switching block and the sensing units performed during the second period of FIG. 10 according to an embodiment.

FIG. 10 shows the timings of the control signals for controlling the switches included in the circuit configuration of FIG. 9 according to an embodiment, FIG. 11 shows the operations of a switching block and sensing units performed during the first period of FIG. 10, and FIG. 12 shows the operations of the switching block and the sensing units performed during the second period of FIG. 10.

In FIG. 10, in a first period T1, k-th sensing line SL#k is connected to k-th sensing unit SU#k, and in a second period T2, k-th sensing line SL#k is connected to (k+1)-th sensing unit SU#(k+1). In the first period T1, the first switch A#k connecting k-th sensing line SL#k to k-th sensing unit SU#k is turned on, the reset switch RST and sampling switch SAM are turned on in order for k-th sensing unit SU#k to process the test current input through k-th sensing line SL#k. In the second period T2, the second switch B#(k+1) connecting k-th sensing line SL#k to (k+1)-th sensing unit SU#(k+1) is turned on, the reset switch RST and sampling switch SAM are turned on in order for (k+1)-th sensing unit SU#(k+1) to process the test current input through k-th sensing line SL#k.

In FIG. 11 showing the connection state of the first period, the first switch A#k is turned on, and the test current from k-th sensing line SL#k is input to k-th sensing unit SU#k so the test current is stored in the holding capacitor Ch via the current integrator CI and the sampling switch SAM. The ADC converts the voltage in the holding capacitor supplied through the holding switch HOLD into digital data (calibration data) and outputs it to the timing controller 11.

In FIG. 12 showing the connection state of the second period, the second switch B#(k+1) is turned on, and the test current from k-th sensing line SL#k is input to (k+1)-th sensing unit SU#(k+1) so the test current is stored in the holding capacitor Ch via the current integrator CI and the sampling switch SAM. The ADC converts the voltage in the holding capacitor supplied through the holding switch HOLD into digital data (calibration data) and outputs it to the timing controller 11.

The calibration data output in the first period and the second period are two values obtained by processing a same test current output from a same sensing line in k-th sensing unit SU#k and (k+1)-th sensing unit SU#(k+1) respectively, so the difference between two values correspond to the characteristic difference of the two sensing units.

The timing controller 11 may obtain the compensation value which can correct the difference between k-th sensing unit SU#k and (k+1) -th sensing unit SU#(k+1), by using the calibration data output in the first period and the second period.

For each source drive IC, the timing controller 11 may generate the compensation data for correcting the characteristic differences (the differences of the characteristics of generating sensing data from a received pixel current) among the sensing units included in a corresponding source drive IC, by using the calibration data which each of two adjacent sensing units receiving a same test current outputs through the ADC. The timing controller 11 may generate the compensation data for correcting the characteristic differences among the source drive ICs in a similar manner.

Also, the timing controller 11 may reduce the deviation among display devices, by comparing the calibration data which a sensing unit (for example the first sensing unit of the first source drive IC) outputs via the ADC by processing the reference current of a precise value input from a reference current source and the calibration data which the sensing unit outputs via the ADC by processing the test current input from a certain sensing line.

Figure 13:
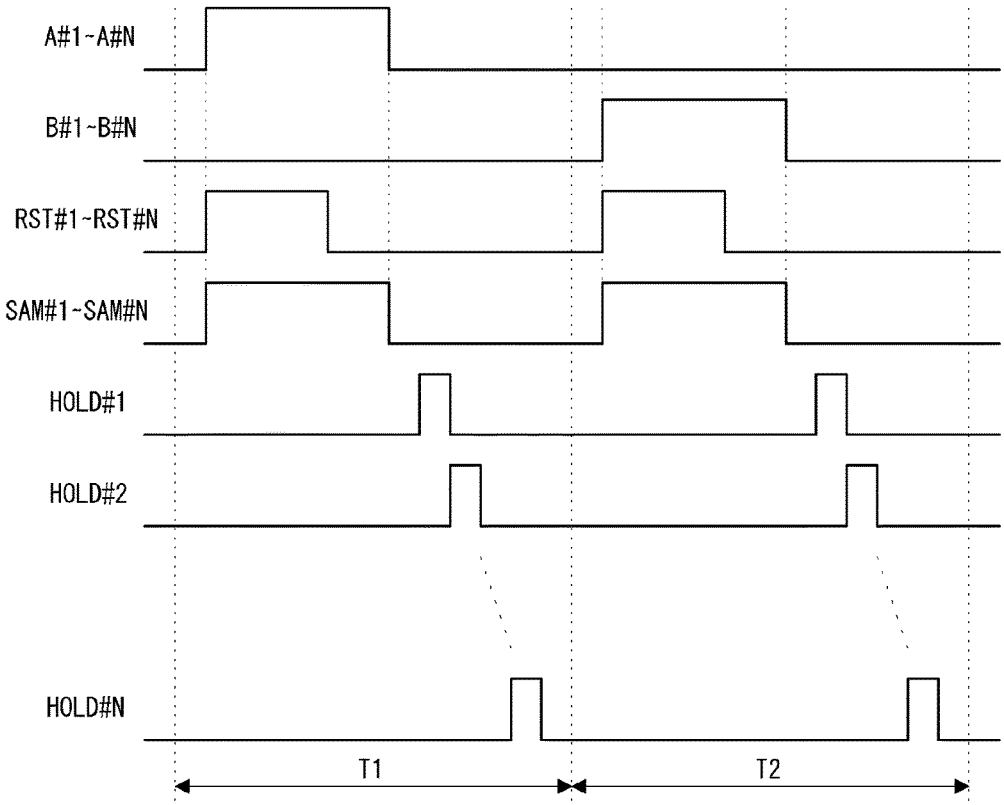
FIG. 13 shows the timings of the control signals for controlling the switches included in the circuit configuration of FIG. 9 according to another embodiment.

FIG. 13 shows the timings of the control signals for controlling the switches included in the circuit configuration of FIG. 9 according to another embodiment.

In the previous embodiment, the first switches connecting a sensing unit to a corresponding sensing line operate in order of A#1->A#2->. . . ->A#N, and the second switches connecting a sensing unit to the sensing line adjacent and previous to a corresponding sensing line operate in order of B#1->B#2->. . . ->B#N.

In the timings of FIG. 13, during the first period T1, the first switches A#1~A#N are simultaneously turned on to respectively connect all sensing units to corresponding sensing lines, and then the holding switches HOLD included in respective sensing unit and connecting the sensing unit to the ADC are sequentially turned on (for example in order of HOLD#1->HOLD#2->. . . ->HOLD#N, where HOLD#1, HOLD#2 and HOLD#N respectively indicate the holding switches included in the first, second and N-th sensing units) to sequentially connect the sensing units to the ADC, so the calibration data for respective sensing units according to the test currents may be obtained.

Also, during the second period T2, the second switches B#1~B#N are simultaneously turned on to respectively connect all sensing units to the sensing lines adjacent and previous to corresponding sensing lines or the reference current source, and then the holding switches HOLD are sequentially turned on to sequentially connect the sensing units to the ADC, so the calibration data for respective sensing units according to the test currents or the reference current may be obtained.

Of course, during the first period T1, the second switches B#1~B#N may be simultaneously turned on, and then during the second period T2, the first switches A#1~A#N may be simultaneously turned on.

The present disclosure can reduce the time required for the calibration driving by L/2 times when the number of source drive ICs is L, even though using only one reference current source, compared with the conventional calibration method in FIG. 1 which uses one reference current source.

Figure 2:
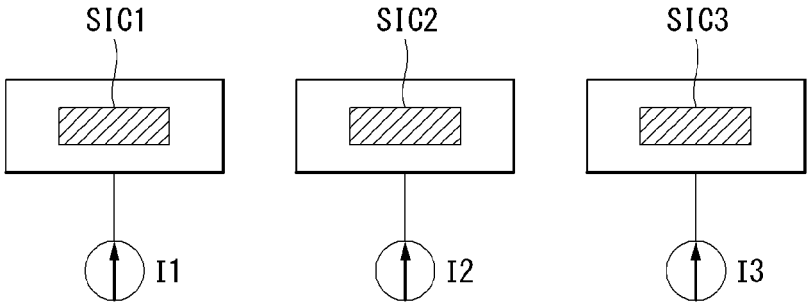
FIG. 2 shows the configuration implementing a second conventional calibration method.

The conventional calibration method in FIG. 2, which uses a plurality of reference current sources as many as the number of source drive ICs, requires the step of connecting a first current source to a second source drive IC (similarly connecting a second current source to a third source drive IC) and the step of connecting each current source to each sensing unit, in order to reduce the deviation between the reference current sources. The present disclosure can further reduce the time required for the calibration driving and reduce the deviation between the sensing channels by using only a single reference current source.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. A display device, comprising:

a display panel including a plurality of pixels each of which is connected to one of a plurality of data lines and one of a plurality of sensing lines;

a reference current source configured to provide a reference current; and a source drive integrated circuit (IC), including a plurality of sensing units for sampling a signal input from a pixel through a sensing line and an analog-to-digital converter (ADC) connected to the plurality of sensing units, configured to provide a data voltage to the pixel through a data line, and obtain sensing data related to a driving of the pixel, wherein the source drive IC further comprises a switch array connecting the plurality of sensing lines and the plurality of sensing units, wherein the switch array in each sensing unit comprises a first switch for connecting a corresponding sensing unit to a first sensing line corresponding to the corresponding sensing unit, and a second switch for connecting the corresponding sensing unit to a second sensing line adjacent and previous to the first sensing line or the reference current source, and wherein each sensing unit is connected to the first sensing line through the first switch to receive a first test current, and then connected to the second sensing line through the second switch to receive a second test current or connected to the reference current source through the second switch to receive the reference current, or each sensing unit is connected to the second sensing line through the second switch to receive the second test current or connected to the reference current source through the second switch to receive the reference current, and then connected to the first sensing line through the first switch to receive the first test current.

2. The display device of claim 1, wherein a first sensing unit of a first source drive IC is connected to the reference current source through the second switch.

3. The display device of claim 1, wherein a first sensing unit of each source drive IC except for a first source drive IC is connected to a sensing line corresponding to a last sensing unit of a source drive IC adjacent and previous to a corresponding source drive IC through the second switch.

4. The display device of claim 1, wherein the source drive IC obtains first calibration data corresponding to the first test current in a first period and obtains second calibration data corresponding to the second test current in a second period, for each sensing unit, or the source drive IC obtains first calibration data corresponding to the second test current or the reference current in the first period and obtains second calibration data corresponding to the first test current in the second period, for each sensing unit.

5. The display device of claim 4, further comprising:

a timing controller configured to process the sensing data and the first and second calibration data output from the source drive IC, wherein the timing controller is configured to compare the first calibration data obtained by a first sensing unit in the first period and the second calibration data obtained by a second sensing unit adjacent to the first sensing unit in the second period, and calculate a compensation data to correct a deviation between the sensing data obtained by the first sensing unit and the sensing data obtained by the second sensing unit.

6. The display device of claim 1, wherein the first test current is provided from a pixel connected to the first sensing line and disposed in a predetermined pixel line, or provided from a current source or a dummy pixel disposed in a non-display area and connected to the first sensing line, and wherein the second test current is provided from a pixel connected to the second sensing line and disposed in the predetermined pixel line, or provided from the current source or the dummy pixel disposed in the non-display area and connected to the second sensing line.

7. A method for calibrating a display device, the display device including a plurality of sensing units for sampling a signal input through a sensing line connected to a pixel equipped in a display panel and an analog-to-digital converter (ADC) connected to the plurality of sensing units and obtaining sensing data related to a driving of the pixel, comprising:

in a first period, integrating and sampling a first test current input from a first sensing line corresponding to a first sensing unit by the first sensing unit and converting the sampled value into a first calibration data by the ADC, and integrating and sampling a second test current input from a second sensing line corresponding to a second sensing unit adjacent and next to the first sensing unit by the second sensing unit and converting the sampled value into a second calibration data by the ADC; and in a second period, integrating and sampling a third test current input from a third sensing line adjacent and previous to the first sensing unit or a reference current input from a reference current source by the first sensing unit and converting the sampled value into a third calibration data by the ADC, and integrating and sampling the first test current input from the first sensing line by the second sensing unit and converting the sampled value into fourth calibration data by the ADC.

8. The method of claim 7, wherein, when the display device includes a plurality of source drive IC comprising the plurality of sensing units and the ADC, a first sensing unit of a first source drive IC is connected to the reference current source to receive the reference current and a first sensing unit of each source drive IC except the first source drive IC is connected to a sensing line corresponding to a last sensing unit of a source drive IC adjacent and previous to a corresponding source drive IC to receive a test current, in the second period.

9. The method of claim 7, further comprising:

comparing the first calibration data obtained via the first sensing unit in the first period with the fourth calibration data obtained via the second sensing unit in the second period to extract a compensation value for correcting a deviation between sensing data obtained via the first sensing unit and sensing data obtained via the second sensing unit.

10. A method for calibrating a display device, the display device including a plurality of sensing units for sampling a signal input through a sensing line connected to a pixel equipped in a display panel and an analog-to-digital converter (ADC) connected to the plurality of sensing units and obtaining sensing data related to a driving of the pixel, comprising:

simultaneously connecting the sensing units to sensing lines corresponding to the sensing units, integrating and sampling a test current input from a connected sensing line at each sensing unit, and sequentially connecting the sensing units to the ADC to obtain first calibration data for respective sensing units;

connecting the sensing units to sensing lines adjacent sensing lines corresponding to the sensing units or a reference current source, integrating and sampling a test current input from a connected sensing line or a reference current input from the reference current source at each sensing unit, and sequentially connecting the sensing units to the ADC to obtain second calibration data for respective sensing units; and comparing the first calibration data and the second calibration data which are respectively obtained by a first sensing unit and a second sensing unit adjacent to the first sensing unit based on a same test current input from a same sensing line, to extract a compensation value for correcting a deviation between sensing data obtained via the first sensing unit and sensing data obtained via the second sensing unit.

* * * * *